US005823014A

United States Patent [19]

Kobayashi et al.

[11] Patent Number: 5,823,014

[45] Date of Patent: Oct. 20, 1998

[54] HOSIERY AND PROCESS FOR PRODUCING THE SAME

[75] Inventors: Hirofumi Kobayashi, Aichi-ken; Tadahito Nagayasu, Nagoya; Nagafumi Himeno, Aichi-ken, all of Japan

[73] Assignee: Toray Industries, Inc., Tokyo, Japan

[21] Appl. No.: 319,519

[22] Filed: Oct. 7, 1994

[30] Foreign Application Priority Data

Oct. 15, 1993 [JP] Japan ..... 5-258776

[51] Int. Cl.[6] ..... A41B 9/08; A41B 11/00

[52] U.S. Cl. ..... 66/178 R; 66/169 R; 66/202; 57/3; 57/6; 57/13; 57/225; 57/227; 57/230; 442/306

[58] Field of Search ..... 428/253, 229, 428/230, 231, 365, 373, 377; 66/178 R, 178 A, 169 A, 202; 57/3, 6, 13, 225, 227, 230

[56] References Cited

U.S. PATENT DOCUMENTS

| | | | |
|---|---|---|---|
| 3,940,917 | 3/1976 | Strachan | 57/34 P |
| 3,991,548 | 11/1976 | Toronyi et al. | 57/140 BY |
| 4,226,076 | 10/1980 | Griset, Jr. | 57/12 |
| 4,525,992 | 7/1985 | Payen | 57/18 |
| 4,801,503 | 1/1989 | Jennings | 428/399 |
| 5,267,430 | 12/1993 | Payen | 57/58.32 |

OTHER PUBLICATIONS

Database WPI, Section Ch, Week 8627, Derwent Publications Ltd., London, GB; Class A23, AN 86–171576 & JP–A–61 102 442 (Toray Ind Inc) 21 May 1986 & JP–B–1 003 965 (Toray Ind Inc).

Patent Abstracts of Japan, vol. 18, No. 128 (C–1174) Mar. 2, 1994 & JP–A–05 311 501 (Toray Ind Inc) 22 Nov. 1993.

Patent Abstracts of Japan, vol. 14, No. 275 (C–728) (4218) 14 Jun. 1990 & JP–A–02 080 635 (Toyobo Co Ltd) 20 Mar. 1990.

*Primary Examiner*—Ana Woodward

*Attorney, Agent, or Firm*—Nikaido Marmelstein Murray & Oram LLP

[57] ABSTRACT

An every course hose is produced by knitting substantially exclusively a covered elastic yarn into the leg portion knitting fabric thereof. A covering yarn is wound around an elastic yarn as the core yarn to form the covered elastic yarn. The covering yarn is constituted of a plurality of filaments made of a polyamide substantially free from titanium oxide and having a flat cross section with a flatness (b/a) (the ratio of the length b to the width a) of 2.0 to 6.0.

16 Claims, 5 Drawing Sheets

HOSIERY AND PROCESS FOR PRODUCING THE SAME

BACKGROUND OF THE INVENTION

The present invention relates to an article of hosiery and a process for producing the same, and more particularly to an every course hose having a leg portion knitting fabric formed by knitting substantially exclusively a covered elastic yarn and a precess for producing the same.

Recent years have seen a remarkable innovation of panty hose, i.e., rapid shift from panty hose produced using the conventional false-twist nylon yarn to panty hose produced using a covered elastic yarn constituted of an elastic polyurethane yarn and a nylon yarn twisted around the elastic polyurethane yarn. The panty hose produced using a covered elastic yarn have gained public favor since they have not only excellent close fitting properties due to recovery of the elastic polyurethane yarn after elongation thereof but also good durability.

In the case of panty hose produced using the conventional covered elastic yarn, however, the yarn is knit alternately with a nylon yarn to present the problem of weft bar due to alternate course knitting. As a countermeasure for obviating such weft bar, the so-called every course hose have recently been proposed, wherein a leg portion knitting fabric is formed by knitting only a covered elastic yarn.

Since, however, the covered elastic yarn has a structure wherein a nylon yarn is twisted around an elastic polyurethane yarn, it is liable to become so coarse as to have disadvantages such that the resulting hosiery is poor in transparency, stuffy, large in fabric thickness, etc., as compared with the conventional hosiery produced using a false-twist yarn or a composite fiber. In the case of an every course hose, these disadvantages are increased with additional grave demerits of lost luster feeling and poor flat feeling.

As a measure for solving the foregoing problems, use of a finer covering yarn in a covered elastic yarn has been proposed. Specifically, the fineness of the covering yarn has been considerably reduced to about 7 to 10 deniers as against about 12 to 20 deniers as the fineness of the conventional false-twist yarn for hosiery.

However, this has not necessarily been an effective reform measure because the reduction in the fineness of the covering yarn involves not only a practically unfavorable problem of deteriorating the durability of hosiery but also other problems of an increased cost and a lowered productivity in the process for producing the covering yarn. An increase in the number of windings in covering (count of covering twist) is effective in preventing the durability of hosiery from lowering because of the reduced fineness of the covering yarn, but presents another problem of lowering the production efficiency to fail to become a realistic reform measure.

On the other hand, in the case of the covered elastic yarn, it is important whether the covering performance of the covering yarn wound around the elastic polyurethane yarn is good or not. This is because the durability, fabric appearance, color tone, hand, etc., of hosiery are affected by how uniformly the covering yarn is wound around the elastic polyurethane yarn so as not to expose the surface of the latter.

In view of this, use of a filament yarn having a noncircular cross-section such as a Y-, T-, X-, U-, H-, L- or E-shaped cross section as the covering yarn has been proposed as a measure for improving the covering performance of the covering yarn in Japanese Patent Publication No. 3,965/1989. A high-tenacity filament yarn having a ribbon-like cross section and made of delustered nylon 66 containing titanium oxide has been proposed as the covering yarn for use in a covered elastic yarn in U.S. Pat. No. 4,801,503.

However, the former noncircular cross-section filament yarn has such a recessed surface as is apparent from observation of the cross section thereof in every case to present a problem of notably deteriorating the transparency, flat feeling, etc., of the resulting hosiery, while the latter high-tenacity nylon 66 filament yarn having a ribbon-like cross section is poor in transparency because it contains titanium oxide disadvantageously. Particularly when the latter is knit in alternate courses with a ribbon-like cross-section yarn, the glittering feeling of the resulting alternate course hose is very strong to present a problem of failing to provide a satisfactory fashionability.

Accordingly, application of a covered elastic yarn wherein use is made of the conventional covering yarn involves a difficulty in well improving the transparency, comfortableness in wearing, flat feeling, luster feeling, thick feeling of fabric, etc., of the resulting every course hose.

SUMMARY OF THE INVENTION

An object of the present invention is to provide hosiery improved particularly in transparency and flatness by using an improved covering yarn for a covered elastic yarn for use in an every course hose having a leg portion knitting fabric formed by knitting substantially exclusively the covered elastic yarn.

Another object of the present invention is to provide every course hose having close fitting properties and a durability as well as a transparency, and further improved in flat feeling, luster feeling and thick feeling, etc., of fabric.

Still another object of the present invention is to provide a process for producing an every course hose excellent in transparency, etc.

In order to attain the foregoing objects, the present invention provides an every course hose having at least the leg portion knitting fabric thereof formed by knitting substantially exclusively a covered elastic yarn, characterized in that the covering yarn of the covered elastic yarn is formed of filaments substantially made of a polyamide substantially free from titanium oxide and having a flat cross section with a flatness (b/a) (the ratio of the length b to the width a) of 2.0 to 6.0.

Further, the process of the present invention for producing hosiery is characterized by comprising winding a covering yarn constituted of filaments made of a polyamide substantially free from titanium oxide and having a flat cross section with a flatness (b/a) (the ratio of the length b to the width a) of 2.0 to 6.0 around at least one elastic yarn as the core yarn to form a covered elastic yarn, and subsequently knitting substantially exclusively the covered elastic yarn into at least the leg portion knitting fabric of the hosiery.

Since the covering yarn of the covered elastic yarn is constituted of filaments substantially free from titanium oxide as described above, a good transparency can be secured in an every course hose produced by knitting substantially exclusively the covered elastic yarn into at least the leg portion knitting fabric of the hose. Further, since the tight bonding and covering performances of the above polyamide filaments around the elastic yarn as the core yarn are improved thanks to their flat cross section having a flatness as high as 2.0 to 6.0, the covered elastic yarn is improved in transparency and uniformity to improve not only the close fitting properties, touch, etc., of the every course hose produced by knitting substantially exclusively the covered elastic yarn, but also the durability thereof thanks to little exposure of the elastic yarn.

DETAILED DESCRIPTION OF THE PREFERRED EMBODIMENTS

The hosiery of the present invention encompasses hosiery products such as panty hose, long stockings, and short stockings, wherein the important constituent portion is a leg portion knitting fabric in particular.

Figure 1:
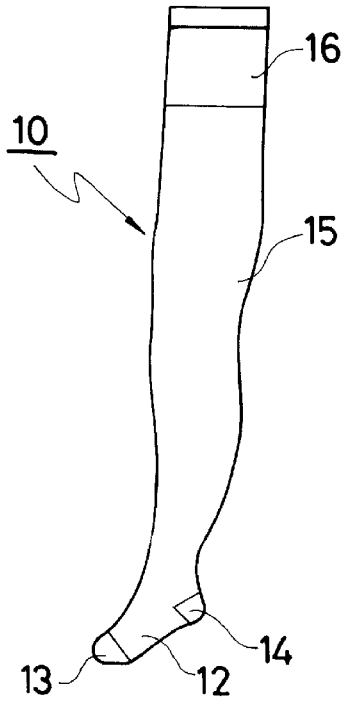
FIG. 1 is a side view of an example of hosiery according to the present invention.

FIG. 1 shows an example of a long stocking according to the present invention. The long stocking 10 is constituted of a toe portion 13 and a heel portion 14 respectively disposed before and behind a sole portion 12 of a foot portion, a leg portion 15 on the upper side of an ankle, and a thick rubber band portion 16 disposed in the upper end portion of the leg portion 15.

Figure 2:
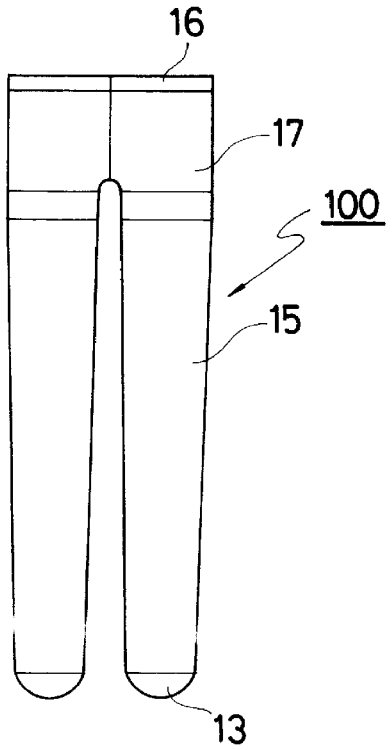
FIG. 2 is a front view of another example of hosiery according to the present invention.

FIG. 2 shows an example of a panty hose according to the present invention. The panty hose 100 comprises a pair of right and left stocking portions mutually integrated through a panty portion 17. The stocking portion is constituted of a leg portion 15 and a toe portion 13. The stocking portion may include a sole portion and a heel portion of a foot portion as similar as in the case of the above-mentioned long stocking.

The hosiery of the present invention is an every course hose produced by knitting exclusively a covered elastic yarn into at least the knitting fabric of the leg portion(s) 15 for the foregoing long stocking or panty hose or the like to thereby obviate weft bar as are developed in an alternate course structure wherein a covered elastic yarn is used in combination with another yarn. Of course, the hosiery of the present invention does not exclude knitting substantially exclusively the covered elastic yarn into portions other than the leg portion(s) 15 in substantially the same manner as in the leg portion(s).

Figure 3:
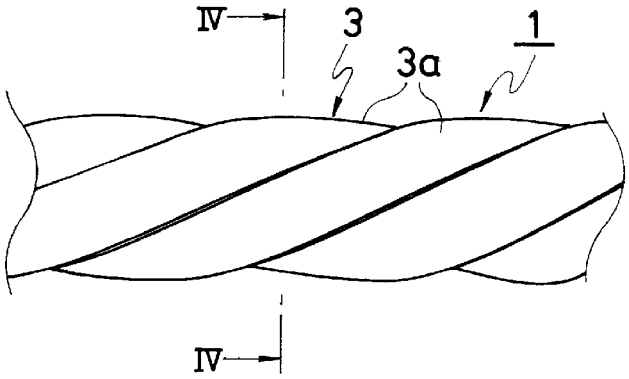
FIG. 3 is a side view of an example of a covered elastic yarn to be used in the hosiery of the present invention.
Figure 4:
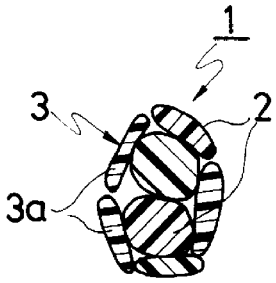
FIG. 4 is a cross-sectional view of the covered elastic yarn taken along line IV—IV of FIG. 3 and viewed in the direction of the arrows.

The covered elastic yarn to be used in the present invention has a structure wherein a covering yarn 3 constituted of a plurality of polyamide filaments 3*a* having a flat cross section and being substantially free from titanium oxide is wound around an elastic yarn 2 as core yarn as illustrated in FIGS. 3 and 4. The polyamide filaments 3*a* of the covering yarn 3 are wound around the elastic yarn 2 in such a way that the surfaces thereof in the direction of the major axis of the cross section thereof constitute the outer surface of the covered elastic yarn 1, whereby the transparency, feeling and luster feeling of hosiery can be improved.

Figure 7:
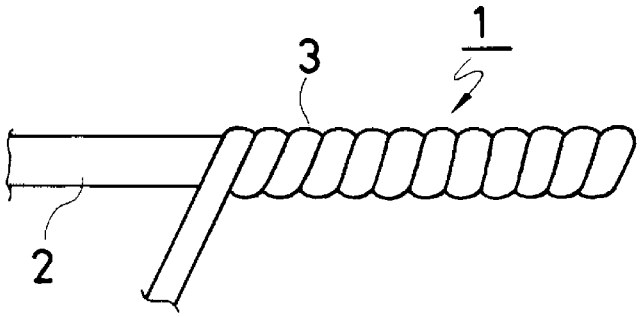
FIG. 7 is a model diagram of an example of a covered elastic yarn to be used in the present invention.
Figure 8:
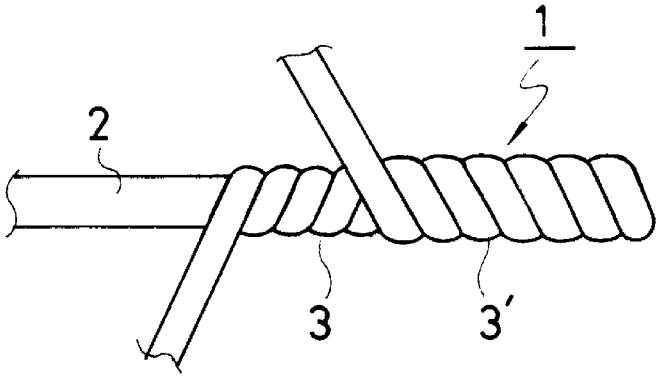
FIG. 8 is a model diagram of another example of a covered elastic yarn to be used in the present invention.

A covered elastic yarn as shown in FIG. 3 is a single covered elastic yarn having a covering yarn 3 singly wound around an elastic yarn 2 as illustrated in FIG. 7. Alternatively, the covered elastic yarn to be used in the present invention may be a double covered elastic yarn wherein two covering yarns 3 and 3' are doubly wound around an elastic yarn 2 in mutually opposite directions of twist, respectively, as illustrated in FIG. 8.

Any polyamides such as nylon 6 and nylon 66, which are used for common polyamide fibers, can be used as the material of the polyamide filaments constituting the covering yarn to be used in the present invention. Among others, nylon 6 is especially preferable. This is because a nylon 6 fiber can so easily enhance the transparency of hosiery as compared with a nylon 66 fiber as to be suitable particularly for a covering yarn of a covered elastic yarn for use in an every course hose wherein a transparency is required of the fiber itself.

The nylon 6 fiber is preferably made of a polyamide constituted of nylon 6 units alone, but may be made of a polyamide constituted of nylon 6 units and other polymer units copolymerized therewith, such as nylon 66 units or nylon 610 units, in so far as the latter is used in such a small amount as not to spoil the mechanical properties, transparency, etc., of the fiber, e.g., in an amount of at most about 3 mol %. Similarly, nylon 6 may be blended with other polymer in so far as the latter is used in such a small amount as not to spoil the mechanical properties, transparency, etc., of the resulting filer, e.g., in an amount of at most about 3 wt. %.

The degree of polymerization of the foregoing polyamide is preferably in the range of 2.5 to 3.5 in terms of relative viscosity in 98% sulfuric acid. In the above-mentioned range, the tenacity and elongation characteristics of the resulting covering yarn and the durability of the resulting every course hose can be enhanced to respective desired levels.

The above-mentioned polyamide may be admixed with additives such as a light stabilizer, a heat stabilizer, an antioxidizing agent, an antistatic agent or a dyeability improver, if necessary, in so far as the latter does not spoil the transparency of the polyamide. However, the polyamide must be substantially free from any delusterants, pigments, or the like, represented by titanium oxide, oxide, e.g., containing significantly less than 0.22 wt % of titanium oxide. Thus, disuse of titanium oxide can improve not only the transparency but also the feeling, durability, etc., of the resulting every course hose.

In general, the conventional polyamide fibers contain titanium oxide blended therein as a delusterant. Particularly in the case of noncircular cross-section fibers liable to have a great glittering feeling on the surfaces thereof, it has been considered indispensable to blend therein titanium oxide in order to suppress the glittering feeling. When, however, titanium oxide is incorporated even in a small amount of 0.22 wt % into the covering yarn of a covered elastic yarn for use in an every course hose, a difficulty is encountered in improving the transparency of the hose.

Since a flat cross-section filament yarn itself has a great glittering feeling, an alternate course hose produced by knitting a covered elastic yarn alternately with the flat cross-section filament yarn as an alternate course yarn is very strong in glittering feeling. When, however, such a flat cross section filament yarn is wound around core yarn to form a covered elastic yarn and a leg portion knitting fabric is formed by knitting exclusively the covered elastic yarn in the production of a hose, it is possible that the glittering feeling inherent in the flat cross-section filament yarn is hardly manifested in the knitting fabric of the hose. Accordingly, the every course hose of the present invention can be enhanced in transparency with no glittering feeling thanks to disuse therein of titanium oxide.

When the polyamide of the polyamide filaments constituting a covering yarn is incorporated with 0.01 to 1.0 wt. %, based on the polyamide, of at least one of acid amide compounds represented by either of the following formulae (A) and (B), the resulting hosiery can be not only further improved in transparency, but also improved in feeling and hand.

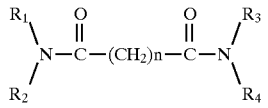

(A)

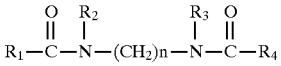

(B)

(wherein $R_1$ and $R_4$ are each an alkyl group having 10 to 20 carbon atoms; $R_2$ and $R_3$ are each a hydrogen atom, a methyl group, or an ethyl group; and n is an integer of 1 to 10).

These acid amide compounds are compounds that can be prepared by the reaction of a dicarboxylic acid with an alkylmonoamine or the reaction of a monocarboxylic acid with an alkylenediamine, and represented by ethylene-bis-stearylamide.

Examples of the diamine to be used in the reaction include alkylenediamines having 1 to 10 carbon atoms, such as methylenediamine, ethylenediamine, propylenediamine, and butylenediamine. Examples of the alkylmonoamine include primary amines having an alkyl group having 10 to 20 carbon atoms, such as octadecylamine, methyloctadecylamine, and ethyloctadecylamine; and secondary amines in the form of such primary amines further substituted by a methyl group or an ethyl group.

Examples of the dicarboxylic acid to be used include dicarboxylic acids having 2 to 12 carbon atoms, such as succinic acid, adipic acid, and sebacic acid. Examples of the monocarboxylic acid, includes alkylmonocarboxylic acids having 12 to 22 carbon atoms, such as lauric acid, palmitic acid, and stearic acid.

Figure 5:
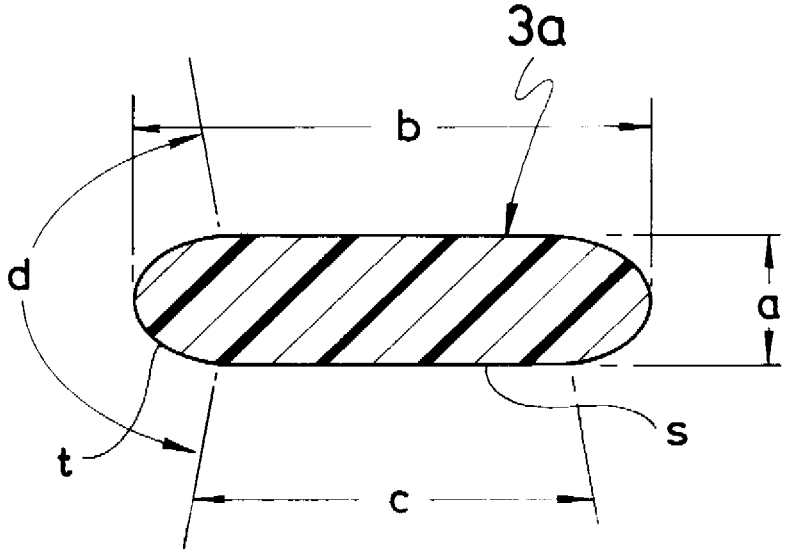
FIG. 5 is a transverse cross-sectional view of a filament constituting a covering yarn of a covered elastic yarn to be used in the present invention.
Figure 6:
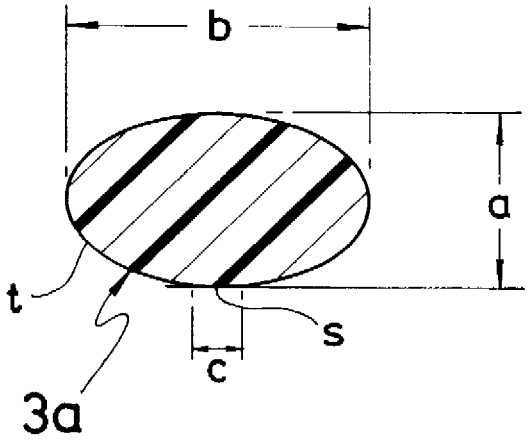
FIG. 6 is a transverse cross-sectional view of a filament constituting a covering yarn as a comparative example for the present invention.

As shown in FIG. 5, a filament 3*a* constituting the covering yarn 3 of the covered elastic yarn to be used in the present invention has a flat cross section wherein the flatness (b/a) is in the range of 2.0 to 6.0, preferably 3.0 to 5.0. Specifically, the filament 3*a* is characterized by having the configuration of a flat cross section having a high flatness as shown in FIG. 5. As opposed to this, a low flatness as shown in FIG. 6 is undesirable. The flatness (b/a) is a value calculated from the length b and width a of the cross section of a filament 3*a* as measured in the photograph thereof.

Filaments having a flat cross section with a flatness (b/a) as high as 2.0 to 6.0 can be obtained by using a spinning nozzle having a slit-like orifice having a high length-to-width ratio of at least 10.

When filaments have a very flat cross section with a flatness (b/a) exceeding 6.0, the durability, dyeing fastness and transparency of the resulting knitting fabric are lowered. In this case, furthermore, the frictional resistance of the filaments is increased in the steps of drawing and covering to cause many troubles such as reverse winding thereof around a roller. On the other hand, when the flatness (b/a) is lower than 2.0, no effect of the flat cross section can be manifested to fail to attain the objects of the present invention.

The configuration of the flat cross section of a filament 3*a* constituting the covering yarn 3 is constituted of two substantially linear portions s and two substantially protruding arched portions t in combination with each other, and desirably has a nonrecessed flat form, e.g., free from discernable recessed portions. Since the filaments of the covering yarn of the covered elastic yarn have such a nonrecessed flat cross section, the knitting fabric of hosiery is balanced between light transmission and reflection to make the hosiery excellent not only in transparency and luster but also in feeling.

In the configuration of the foregoing nonrecessed flat cross section, the linearity ratio (c/a) of the length c of the linear portions s in the direction of the major axis thereof to the width a is preferably at least 1.0. The length c of the linear portions s of the periphery of the cross section in the direction of the major axis thereof may be measured in terms of length of one of peripheral portions thereof substantially overlapping the tangential lines in the direction of the major axis thereof. When the linearity ratio (c/a) is lower than 1.0, a difficulty is encountered in obtaining a knitting fabric having an appearance full of luster feeling and cool feeling because the flat portions of the periphery of the cross section of the filament in the direction of the major axis thereof are small. On the other hand, when any recessed surface portions exist in the periphery of the filament, particularly in the surface portions of the filament in the direction of the major axis of the cross section thereof, the resulting knitting fabric is liable to be opaque and hence low in transparency due to the irregular reflection of light from the surface thereof.

The aforementioned covering yarn may have a fineness of 5 to 15 deniers and constituted of 2 to 7 polyamide filaments. The fineness of the yarn is preferably 5 to 10 deniers, in which case the resulting hosiery can be further improved in transparency and endowed with excellent durability and feeling in wearing thereof. When the fineness of the covering yarn is smaller than 5 deniers, the durability of the resulting hosiery is poor from the practical point of view. On the other hand, when it exceeds 15 deniers, the resulting hosiery is liable to have a poor transparency and a rough and stiff hand.

When the number of filaments in the covering yarn is 2 to 7, the resulting hosiery is further enhanced not only in transparency but also in feeling in wearing thereof and durability. Use of a single filament alone in the covering yarn is liable to give a rough and stiff hand and a poor durability to the resulting hosiery. On the other hand, when the number of filaments in the covering yarn is 8 or more, the transparency and durability of the resulting hosiery are poor.

Examples of the elastic yarn to be used as the core yarn of the covered elastic yarn in the present invention include an elastic polyurethane yarn, an elastic polyamide elastomer yarn, an elastic polyester elastomer yarn, an elastic natural rubber yarn, an elastic synthetic rubber yarn, and an elastic polybutadiene yarn. Among them, the elastic polyurethane yarn and the elastic polyamide elastomer yarn are especially preferred from the viewpoint of their elastic properties, thermal properties, durability, etc.

The number of filaments in the elastic yarn to be used as the core yarn is at least 1, preferably 1 to 3. The fineness of the core yarn, though variable depending on the kind and predetermined tightening pressure of hosiery, may be in the range of about 8 to 70 deniers, preferably 10 to 40 deniers. When it is smaller than 8 deniers, the tenacity of the core yarn is insufficient and hence liable to cause troubles such as core yarn breakage in the steps of covering and knitting, while making the resulting hosiery poor in stretchability and durability. On the other hand, when it exceeds 70 deniers, the resulting hosiery is too strong in tightening force, and hence strong in the feeling of pressure, while involving a decrease in transparent feeling and an increase in rough and stiff feeling.

In the step of producing the covered elastic yarn in the production of the hosiery of the present invention, a covering yarn constituted of a plurality of filaments having a flatness as specified hereinbefore and made of a polyamide including significantly less than 0.22 wt % titanium oxide may be either singly or doubly wound around core yarn constituted of at least one elastic yarn according to the customary method. In this step of winding the covering yarn around the core yarn, desirably the covering yarn is twisted slightly or interlaced slightly. The count of twist of twisting the twisted covering yarn is at most 14 t/m, preferably in the range of 0 to 14 t/m. The count of interlacing of the interlaced covering yarn is at most 5/m, preferably in the range of 0 to 5/m.

Use of the slightly twisted or slightly interlaced covering yarn facilitates disposing the surfaces of the filaments thereof in the direction of the major axis of the cross section thereof in such a way that the surfaces constitute the outer surface of the covered elastic yarn to thereby improve the flat feeling and transparent feeling of the resulting hosiery.

The hosiery of the present invention must have the leg portion knitting fabric thereof formed by knitting substantially exclusively the covered elastic yarn. However, this does not exclude added minor additional application of a knit-in pattern or one-point decoration made of other material to the leg portion knitting fabric. Use of the covered elastic yarn as specified in the present invention in alternate course knitting thereof in combination with a common nylon yarn, though somewhat effective in improving the luster feeling of the resulting hosiery, is little effective in improving other properties of the hosiery to fail to attain the objects of the present invention.

The leg portion knitting fabric of hosiery may be formed by knitting using a knitting machine with two or four yarn feeding ports while feeding thereto only the covered elastic yarn according to the customary method. In the case of single covered elastic yarns, an S-directed single covered elastic yarn is favorably knit alternately with a Z-directed single covered elastic yarn.

In the case of an every course hose having a leg portion knitting fabric formed by knitting only a covered elastic yarn in the manner as described above, the power level of the hose generally tends to be too high. In view of this, the 60% recovery stress as the power level is set to be preferably in the range of 180 to 350 g, further preferably in the range of 200 to 300 g. The 60% recovery stress of hosiery serves as the index of the close-fitting properties thereof. When it is lower than 180 g, the hosiery is liable to wrinkle or sag when worn. On the other hand, when it is so high as to exceed 350 g, the tightening pressure of the hosiery is so high as to strengthen the tight feeling and stuffy feeling thereof, while too large a shrinkage of the hosiery is liable to spoil the uniform appearance thereof.

In order to set the 60% recovery stress on the level as specified above, it is especially effective to impart to the elastic yarn as the core yarn suitable elastic recovery properties, and it is also effective to control the constitution of the covered elastic yarn, the conditions of knitting, dyeing and finishing, and so forth.

When the power level of hosiery is enhanced as described above, the conventional every course hose are deteriorated in the appearance of fabric due to shrinkage of the fabric, whereas the hosiery of the present invention can secure a good appearance of fabric with suppression of nonuniform shrinkage of the fabric thanks to uniform covering properties of the covering yarn of the covered elastic yarn and hence little exposure of the elastic yarn as the core yarn. Furthermore, use of the covered elastic yarn having the aforementioned structure improves the capability of passing the steps of knitting and finishing.

The 60% recovery stress was determined according to the following measurement procedure. A hose sample is extended under a load of 2 kg hooked on one end of the sample to measure the length l of the sample. Subsequently, the hose sample is folded double and placed in a constant extension type tensile tester Model TOM-100E (manufactured by Shinkoh Communication Industry Co., Ltd.), with which a stress-strain hysteresis curve is then drawn until 75% recovery of one half of the length l after the extension of the sample. The 60% recovery stress (g) is a value of stress at a point of recovery of 60% of l/2 as the extended length, which value is obtained from the recovery curve of the hysteresis curve.

As described hereinbefore, the hosiery of the present invention has not only very good transparency, close fitting properties and durability unattainable by the conventional every course hose, but also an excellent touch and a soft hand. Furthermore, the hosiery of the present invention can be excellent in flat feeling, luster feeling and dyeing fastness of the fabric thereof.

A description will now be made on Examples, wherein the values of properties mentioned were measured as follows.

Transparency: The leg portion knitting fabric of a hosiery product was doubled in a state of the 15 cm-wide thigh portion thereof being spread at 150 courses/5 cm, allowed to stand still on a color standard white board (L value: 88.29) to measure the L value (Lw) of the knitting fabric with a color-difference meter Σ80 (manufactured by Nippon Denshoku Kogyo K.K.), and then allowed to stand still on a color standard black board (L value: 7.74) to measure the L value (Lb) of the knitting fabric with the color-difference meter. The transparency was calculated from these L values according to the following formula. The higher the calculated value, the better the transparency.

$$\text{transparency}=(Lw-Lb)/(W-B)$$

wherein W stands for the L value of the color standard white board, and B stands for the L value of the color standard black board.

Feeling properties: A hosiery product was worn on a human leg model and relatively evaluated by the touches thereon of 5 panelists with respect to soft feeling, flat feeling, cool feeling and agreeability to the touch. The results are represented by the following ratings: ◎ very good, ○: good, Δ: slightly poor, and x: poor.

Durability: The bursting strength of a hosiery product was measured using a Mullen high-pressure tester according to the bursting strength test method as described in JIS (Japanese Industrial Standards) P 8131. Levels of bursting strength are represented by the following ratings: ◎: at least 1.2 kg/cm$^2$, ○: at least 1.0 kg/cm$^2$ to lower than 1.2 kg/cm$^2$, Δ: at least 0.9 kg/cm$^2$ to lower than 1.0 kg/cm$^2$, and x: lower than 0.9 kg/cm$^2$.

Appearance of fabric: This was relatively evaluated with the naked eyes of 5 panelists. The results are represented by substantially the same ratings as in the Feeling properties mentioned above.

Close-fitting properties: They were evaluated according to the wearing test method wherein panelists each repeatedly wore a hosiery product for 8 hours per day on 3 days. The results are represented by substantially the same ratings as in the Feeling properties mentioned above.

The foregoing ratings of relative evaluation are all based on relative evaluation throughout the following Examples 1 to 3.

Dyeing fastness: A test piece of fabric was washed with washing water having a soap concentration of 0.5 wt. % at a temperature of 50 ±2° C. for a washing period of 30 minutes in a launderometer type washing tester according to the washing fastness test method as described in JIS L 0821. The degree of browning of the test piece of fabric after washing in comparison with the color thereof before washing was judged according to the gray scale for browning (ratings: 5 to 1). The rating 5 corresponds to "very good," 4 to "good," 3 to "slightly poor," and 2–1 to "poor."

EXAMPLE 1

Nylon 6 having a relative viscosity in 98% sulfuric acid of 2.8 and containing no titanium oxide was melted at 270° C., delivered at a rate of 800 m/min from a spinning nozzle having delivery ports in the shape of slits differing in shape and having a width of 0.1 mm and respective lengths of 1.0 to 2.5, and taken up as undrawn yarns. Subsequently, each of the undrawn yarns was drawn so as to have an elongation of 40 to 45% to thereby obtain a 10-denier nylon 6 yarn of 5 filaments having a flat cross section with a flatness (b/a) of 2.5 to 7.0 (Nos. 1 to 6). The flatness (b/a) differed from yarn to yarn.

For comparison, nylon 6 having a relative viscosity in 98% sulfuric acid of 2.6 and containing no titanium oxide was spun, and then drawn in the same manner to obtain a nylon 6 yarn of filaments having a flatness (b/a) of 1.7 (No. 7).

For further comparison, nylon 6 having a relative viscosity in 98% sulfuric acid of 2.8 and containing 0.22 wt. % of titanium oxide was spun and then drawn in the same manner to obtain a nylon 6 yarn of filaments having a flatness (b/a) of 4.0 (No. 8).

For still further comparison, the same nylon 6 as used in No. 1 of this Example was melt-spun and then drawn in substantially the same manner except for the use of a spinning nozzle having circular delivery ports to obtain a nylon 6 yarn of filaments having a circular cross section (No. 9).

Figure 9:
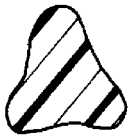
Fig. 9 PRIOR ART
FIG. 9 is a transverse cross-sectional view of a filament as used in a prior art covering yarn.
Figure 10:
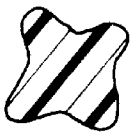
Fig. 10 PRIOR ART
FIG. 10 is a transverse cross-sectional view of another example of a filament as used in a prior art covering yarn.

For still further comparison, the same nylon 6 as used in No. 1 of this Example was melt-spun and then drawn in substantially the same manner except for the use of spinning nozzles respectively having mutually different delivery port shapes to respectively obtain a nylon 6 yarn of filaments having a noncircular Y-shaped cross section having a degree of deformation (the ratio of the radius of a circumcircle to that of an inscribed circle) of 1.6 as shown in FIG. 9 and a nylon 6 yarn of filaments having a noncircular X-shaped cross section having a flatness (b/a) of 1.7 as shown in FIG. 10 (Nos. 10 and 11).

The peripheries of the flat cross sections of the filaments of the yarns Nos. 1 to 8 are constituted of two substantially linear portions and two substantially protruding arched portions, and are substantially free from recessed portions like those of FIGS. 5 and 6.

Each of these nylon 6 yarns was preliminarily twisted at a count of twist of 12 t/m, and then used as a covering yarn. A 15-denier polyether polyurethane elastic fiber Spandex was used as the core yarn. The covering yarn was wound around the core yarn at a draft ratio of the core yarn of 2.8 at a count of twist of 2,000 t/m for winding the covering yarn around the core yarn. An S-directed single covered elastic yarn and a Z-directed single covered elastic yarn were produced according to the foregoing procedure.

Figure 11A:
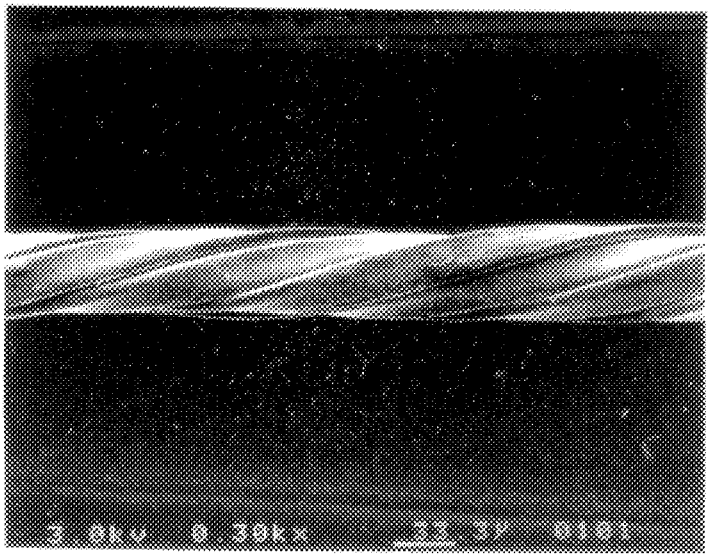
FIG. 11A is a scanning electron microscope view of a covered elastic yarn produced in the Example according to the present invention.

Every single covered elastic yarn produced by winding a covering yarn of filaments having a flat cross section around the core yarn according to the present invention had the filaments of the covering yarn disposed in such a way that the surfaces of the filaments in the direction of the major axis of the cross sections thereof constituted the outer surface of the covered elastic yarn as can be seen in the photograph of FIG. 11A.

Single covered elastic yarns thus obtained were used for knitting on a Super 4 knitting machine (number of needles: 400) manufactured by Nagata Seiki Co., Ltd. The S-directed single covered elastic yarn and the Z-directed single covered elastic yarn were alternately fed into the yarn feeding port of the knitting machine to form a panty hose having a leg portion knitting fabric formed by knitting only the covered elastic yarns. The panty hose was then dyed finished, and set over a pattern plate to produce a panty hose product.

Figure 11B:
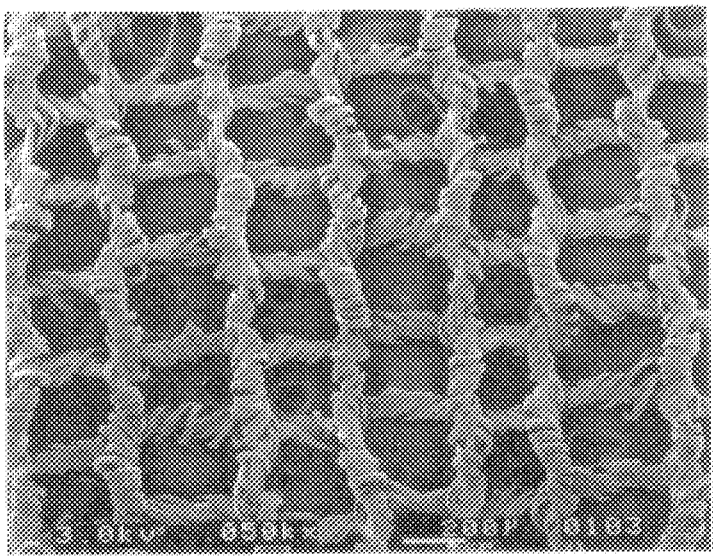
FIG. 11B is a scanning electron microscope view of a leg portion knitting fabric of hosiery formed by knitting the covered elastic yarn of FIG. 11A.
Figure 12A:
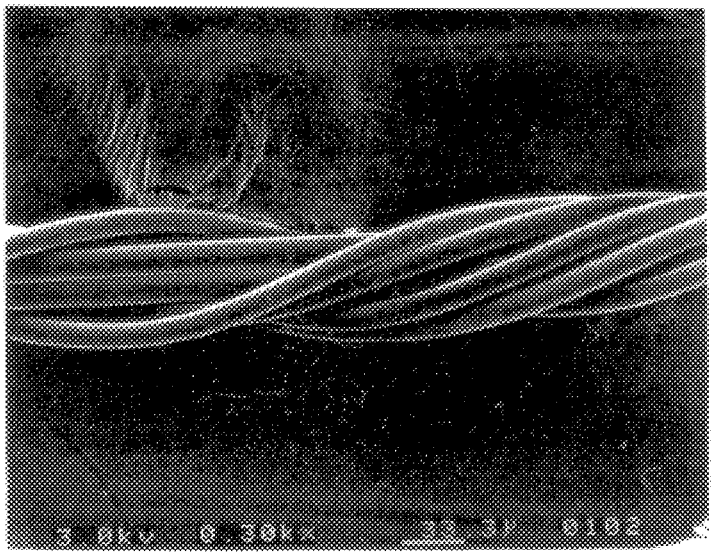
FIG. 12A is a scanning electron microscope view of the conventional covered elastic yarn.

The covered elastic yarns of No. 3 (flatness: 4.0) and No. 9 (circular cross section) were as viewed under the scanning electron microscope (magnification: ×500) of FIGS. 11A and 12A, respectively. The leg portion knitting fabrics of the panty hose products of Nos. 3 and 9 were as viewed under the scanning electron microscope (magnification: 40) of FIGS. 11B and 12B, respectively.

Every single covered elastic yarn produced by winding a covering yarn of filaments having a flat cross section around the core yarn had the filaments of the covering yarn disposed in such a way that the surfaces of the filaments in the direction of the major axis of the cross sections thereof constituted the outer surface of the covered elastic yarn as observed under the scanning electron microscope of FIG. 11A.

The results of evaluation of the leg portion of the panty hose product thus obtained were as shown in Table 1.

TABLE 1

| | Covering yarn of covered elastic yarn | | | | Properties of leg portion knitting fabric of hose | | | | | | |
|---|---|---|---|---|---|---|---|---|---|---|---|
| | Cross-section of filament | | | $TiO_2$ | | Feeling Properties | | | | | |
| No. | Shape | Flatness (b/a) | Linearity Ratio (c/a) | Content (wt. %) | Transparency (%) | Soft Feeling | Cool Feeling | Agreeability to Touch | Flat Feeling | Dura-bility | Dyeing Fastness (rating) |
| 1 (Invention) | flat | 2.5 | 1.2 | 0 | 39 | ◎ | ○ | ○ | ○ | ○ | 5 |
| 2 (Invention) | flat | 3.0 | 1.6 | 0 | 40 | ◎ | ◎ | ◎ | ◎ | ○ | 5 |
| 3 (Invention) | flat | 4.0 | 2.0 | 0 | 38 | ◎ | ◎ | ◎ | ◎ | ○ | 5 |
| 4 (Invention) | flat | 5.0 | 3.5 | 0 | 36 | ◎ | ◎ | ○ | ◎ | ○ | 5 |
| 5 (Invention) | flat | 3.1 | 0.8 | 0 | 35 | ○ | ○ | ○ | ○ | ○ | 5 |
| 6 (Comp.) | flat | 7.0 | 4.8 | 0 | 30 | ○ | ○ | ○ | ○ | X | 2 |
| 7 (Comp.) | flat | 1.7 | 0.6 | 0 | 34 | ○ | X | Δ | Δ | Δ | 5 |
| 8 (Comp.) | flat | 4.0 | 1.9 | 0.22 | 28 | ◎ | ○ | ○~Δ | ◎ | ○~Δ | 5 |
| 9 (Comp.) | circular | — | — | 0 | 34 | Δ | X | Δ | Δ | X | 5 |
| 10 (Comp.) | Y-shaped | — | — | 0 | 26 | Δ | ○ | Δ | X | ○ | 4 |
| 11 (Comp.) | X-shaped | | — | 0 | 25 | Δ | ○ | Δ | X | ○ | 4 |

As is understandable from the results shown in Table 1 and FIGS. 11A and 11B, the configurations of the covered elastic yarns according to the present invention (Nos. 1 to 5) were uniform and the resulting panty hose according to the present invention (Nos. 1 to 5) were excellent in all of transparency, soft feeling, cool feeling, agreeability to the touch, durability, dyeing fastness, and appearance of fabric. Particularly when the linearity ratio (c/a) exceeded 1.0 (Nos. 1 to 4), the resulting panty hose had very good soft feeling. By contrast, when the flatness exceeded 6.0 (No. 6), the resulting panty hose, though having good feeling properties, was poor in transparency, durability and dyeing fastness.

When use was made of covered elastic yarns each produced by winding a covering yarn of flat cross section filaments containing titanium oxide around the core yarn (No. 8), the resulting panty hose was very poor in transparency and slightly poor in agreeability to the touch.

Figure 12B:
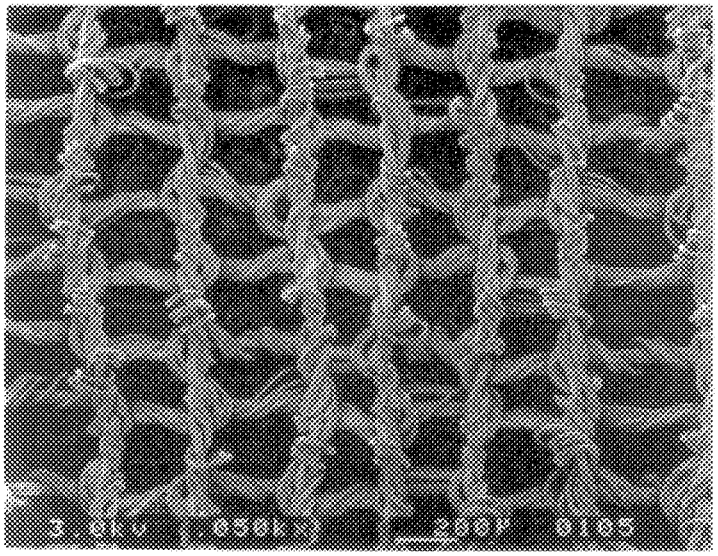
FIG. 12B is a scanning electron microscope view of a leg portion knitting fabric of hosiery formed by knitting the covered elastic yarn of FIG. 12A.

On the other hand, in the case of covered elastic yarns each produced by winding a covering yarn of circular cross section filaments around the core yarn (No. 9), lifting of the covering yarn was observed as demonstrated in FIGS. 12A and 12B. Thus, these yarns were poor in uniformity and covering properties, and the resulting panty hose was poor in appearance of fabric, soft feeling, cool feeling, agreeability to the touch, and durability.

When use was made of covered elastic yarns each produced by winding a covering yarn of flat cross section filaments having a flatness of lower than 2.0 around the core yarn (No. 7), the effects of the flat cross section were unsatisfactory to provide a panty hose poor in soft feeling, cool feeling, agreeability to the touch and durability like in the case of using the covered elastic yarns each produced by winding a covering yarn of circular cross section filaments around the core yarn (No. 9).

When use was made of covered elastic yarns each produced by winding a covering yarn of noncircular Y-shaped or X-shaped cross-section filaments around the core yarn (Nos. 10 and 11), the resulting panty hose, though having good cool feeling and durability, were extremely poor in transparency.

EXAMPLE 2

Nylon 66 having a relative viscosity in 98% sulfuric acid of 2.73 and containing no titanium oxide, and nylon 66 having the same relative viscosity in 98% sulfuric acid but containing 0.22 wt. % of titanium oxide were respectively melted at 285° C., and then melt-spun and drawn in substantially the same manner as in No. 3 of Example 1 to obtain respective 10-denier nylon 66 yarns of 5 filaments having a flat cross section with a flatness (b/a) of 4.0 (count of twist: 10 t/m).

The nylon 66 yarns thus obtained were respectively used as covering yarns to produce single covered elastic yarns in substantially the same manner as in Example 1 (Nos. 12 and 13).

The single covered elastic yarns thus obtained were respectively used to produce panty hose products in substantially the same manner as in Example 1, followed by evaluation thereof. The results were as shown in Table 2.

TABLE 2

| | Covering yarn of covered elastic yarn | | | | Properties of leg portion knitting fabric of hose | | | | | |
|---|---|---|---|---|---|---|---|---|---|---|
| | Cross-section of filament | | | $TiO_2$ | | Feeling Properties | | | | |
| No. | Shape | Flatness (b/a) | Linearity Ratio (c/a) | Content (wt. %) | Transparency (%) | Soft Feeling | Cool Feeling | Agreeability to Touch | Durability | Dyeing Fastness (rating) |
| 12 (Invention) | flat | 4.0 | 2.1 | 0 | 32 | ○ | ○ | ○ | ○ | 5 |
| 13 (Comp.) | flat | 4.0 | 1.6 | 0.22 | 25 | ○ | ○ | ○~Δ | ○~Δ | 5 |

TABLE 3

| | Covering yarn of covered elastic yarn | | | | Properties of leg portion knitting fabric of hose | | | | | | |
|---|---|---|---|---|---|---|---|---|---|---|---|
| | Cross-section of filament | | | $TiO_2$ | | Feeling Properties | | | | | |
| No. | Shape | Flatness (b/a) | Linearity Ratio (c/a) | Content (wt. %) | Transparency (%) | Soft Feeling | Cool Feeling | Agreeability to Touch | Flat Feeling | Dura-bility | Dyeing Fastness (rating) |
| 14 (Invention) | flat | 4.0 | 2.0 | 0 | 30 | ○ | ○ | ◎ | ◎ | ◎ | 5 |
| 15 (Comp.) | circular | — | — | 0 | 25 | Δ | X | Δ | Δ | ◎ | 5 |

As is apparent from the results shown in Table 2, the panty hose according to the present invention (No. 12) was good in respect of all the properties as a whole.

By contrast, when use was made of the covering yarn containing titanium oxide (No. 13), the resulting panty hose was very poor in transparency and slightly poor in agreeability to the touch.

EXAMPLE 3

The flat cross section filament yarn of No. 3 of Example 1 and the circular cross section filament yarn of No. 7 of Example 1 were respectively used as the covering yarns. A 15-denier polyether polyurethane elastic fiber Spandex was used as the core yarn. In each case, lower-side and upper-side covering yarn were wound around the core yarn at a draft ratio of the adding of 3.0 at a count of twist of 2,200 t/m for winding the lower-side covering yarn around the core yarn in the S direction thereof and at a count of twist of 1,900 t/m for winding the upper-side covering yarn around the core yarn in the Z direction thereof to effect double covering to thereby produce a double covered elastic yarn (Nos. 14 and 15).

The double covered elastic yarn thus obtained was used to produce a panty hose in substantially the same manner as in Example 1, followed by evaluation thereof. The results were as shown in Table 3.

As is understandable from the results shown in Table 3, the panty hose according to the present invention (No. 14) was excellent in all of transparency, soft feeling, cool feeling, agreeability to the touch, and durability.

By contrast, when use was made of the double covered elastic yarn produced by winding the circular cross section filament yarn as the covering yarn around the core yarn (No. 15), the resulting panty hose, though excellent in durability due to the use of the double covered elastic yarn, was poor in all other properties.

EXAMPLE 4

Nylon 6 having a relative viscosity in 98% sulfuric acid of 2.8, containing no titanium oxide and containing 0.3 wt. % of ethylene-bis-stearylamide (EBA) was melt-spun and then drawn in substantially the same manner as in No. 2 of Example 1 to obtain a 10-denier nylon 6 yarn of 5 filaments having a cross section with a flatness (b/a) of 3.0 and a linearity ratio (c/a) of 1.6 (No. 16).

The nylon 6 yarn thus obtained and the nylon 6 yarn of No. 2 of Example 1 were respectively used as the covering yarns. 10-, 15- and 20-denier polyether polyurethane elastic fibers Spandex were respectively used as the core yarn. In each case, the covering yarn was wound around the core yarn at a draft ratio of the core yarn of 2.8 to 3.0 at a count of twist of 2,000 t/m to produce a single covered elastic yarn (Nos. 16 to 18).

The single covered elastic yarn thus obtained was used to knit a panty hose in substantially the same manner as in Example 1. The panty hose was dyed, finished and set over a pattern plate according to the customary procedure to produce a panty hose product.

The results of evaluation of the leg portion of the panty hose product thus obtained were as shown in Table 4. The yarn No. 2 of Table 4 is the same as the yarn No. 2 of Example 1.

TABLE 4

| | Covering yarn of covered elastic yarn | | | | Fineness | Draft | Properties of leg portion knitting fabric of hose | | | | | |
|---|---|---|---|---|---|---|---|---|---|---|---|---|
| | Cross-section of filament | | | EBA | of Elastic | Ratio | Recovery | Close- | Appearance | | | Trans- |
| No. | Shape | Flatness (b/a) | Linearity Ratio (c/a) | Content (wt. %) | Yarn as Core Yarn | of Core Yarn | Stress 60% BP (g) | Fitting Properties | of Fabric | Cool Fitting | Dura-bility | parency (%) |
| 16 (Invention) | flat | 3.0 | 1.6 | 0.30 | 15 | 2.8 | 250 | ◎ | ◎ | ◎ | ◎ | 42 |
| 17 (Invention) | flat | 3.0 | 1.6 | 0 | 20 | 3.0 | 380 | ◎ | Δ | Δ | Δ | 37 |
| 2 (Invention) | flat | 3.0 | 1.6 | 0 | 15 | 2.8 | 260 | ◎ | ◎ | ◎ | ○ | 40 |
| 18 (Invention) | flat | 3.0 | 1.6 | 0 | 10 | 2.8 | 160 | ○ | Δ | ◎ | Δ | 41 |

As is understandable from the results shown in Table 4, every panty hose was good in respect of all the properties as a whole.

Among others, in the case of incorporation of ethylene-bis-stearylamide (EBA) into nylon (No. 16), the transparency of the leg portion of the panty hose was further improved.

Further, the higher the 60% recovery stress of the panty hose, the better the close-fitting properties thereof. However, not too high a 60% recovery stress was especially preferable from the viewpoint of appearance of fabric, cool feeling, etc.

What is claimed is:

1. An article of hosiery produced by knitting, said article comprising:

a leg portion consisting exclusively of a covered elastic yarn composed of an elastic core yarn covered by polyamide filaments;

said covering polyamide filaments being composed of zero or less than 0.22 wt. % titanium oxide and formed in a non-recessed flat cross-sectional shape having a flatness ratio b/a in the range of 2.0 to 6.0, wherein b is the length and a is the width of said cross sectional shape.

2. An article of hosiery as claimed in claim 1, wherein the degree of polymerization of said polyamide is 2.5 to 3.5 in terms of relative viscosity in 98% sulfuric acid.

3. An article of hosiery as claimed in claim 2, wherein said polyamide is nylon 6.

4. An article of hosiery as claimed in claim 1, wherein said filaments constituting said covering yarn are disposed in such a way that the surfaces of said filaments in the direction of the major axis of the flat cross sections thereof constitute the entire outer surface of said covered elastic yarn.

5. An article of hosiery as claimed in claim 1, wherein said covering yarn has a fineness of 5 to 15 deniers and a number of filaments of 2 to 7.

6. An article of hosiery as claimed in claim 1, wherein said elastic core yarn is a member selected from the group consisting of an elastic polyurethane yarn, an elastic polyamide elastomer yarn, and an elastic polyester elastomer yarn.

7. An article of hosiery as claimed in claim 1, wherein said covered elastic yarn is a single covered elastic yarn having said covering yarn singly wound around said core yarn.

8. An article of hosiery as claimed in claim 1, wherein said covered elastic yarn is a double covered elastic yarn having two said covering yarns doubly wound around said core yarn in mutually opposite directions.

9. An article of hosiery as claimed in claim 1, wherein the configurations of the flat cross sections of said filaments constituting said covering yearn are each constituted of substantially linear portions and protruding arched portions, and are free from discernable recessed portions.

10. An article of hosiery as claimed in claim 1, wherein said polyamide is a polyamide composition containing 0.01 to 1.0 wt. % of at least one acid amide compound represented by either of the following formulae (A) and (B):

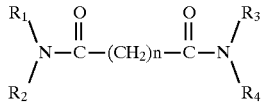

(A)

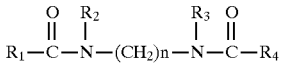

(B)

(wherein $R_1$ and $R_4$ are each an alkyl group having 10 to 20 carbon atoms; $R_2$ and $R_3$ are each a hydrogen atom, a methyl group, or an ethyl group; and n is an integer of 1 to 10).

11. An article of hosiery as claimed in claim 1, wherein the 60% recovery stress of said leg portion knitting fabric is 180 to 350 g.

12. A process for producing an article of hosiery comprising the steps of:

(a) preparing a plurality of polyamide covering filaments containing zero or less than 0.22 wt. % of titanium oxide and having a non-recessed flat form cross section with a flatness ratio b/a in the range of 2.0 to 6.0, wherein b is the length and a is the width of said cross section;

(b) winding said covering filaments around an elastic core yarn to form a covered elastic yarn; and (c) knitting said covered elastic yarn to form at least a leg portion of said article of hosiery.

13. A process for producing an article of hosiery as claimed in claim 12, wherein said covering yarn is twisted at a count of twist of at most 14 t/m.

14. A process for producing an article of hosiery as claimed in claim 12, wherein said covering yarn is interlaced at a count of interlacing of at most 5/m.

15. A process for producing an article of hosiery as claimed in claim 12, wherein said covering yarn is wound around said core yarn in such a way that the surfaces of said filaments in the direction of the major axis of the flat cross sections thereof constitute the outer surface of said covered elastic yarn.

16. A process for producing an article of hosiery as claimed in claim 12, wherein said polyamide is nylon 6.

* * * * *